United States Patent [19]

Androski

[11] 4,149,746

[45] Apr. 17, 1979

[54] REMOTE-CONTROLLED SAFETY HOOK ASSEMBLY

[76] Inventor: Edward C. Androski, P.O. Box 627, Indian Spring, Nev. 98018

[21] Appl. No.: 824,177

[22] Filed: Aug. 12, 1977

Related U.S. Application Data

[63] Continuation-in-part of Ser. No. 722,816, Sep. 13, 1976, Pat. No. 4,073,531.

[51] Int. Cl.[2] ..... B66C 1/38

[52] U.S. Cl. ..... 294/83 R; 294/75

[58] Field of Search ..... 294/75, 78 R, 82 R, 294/83 R, 83 A, 83 AB; 24/230.5 R

[56] References Cited

U.S. PATENT DOCUMENTS

| | | | |
|---|---|---|---|
| 1,221,693 | 4/1917 | Crosby | 294/75 |
| 1,825,018 | 9/1931 | Smith | 294/82 R |
| 2,340,906 | 2/1944 | Suarez | 294/83 R |
| 2,852,217 | 9/1958 | Engelhardt | 294/83 A X |
| 3,056,624 | 10/1962 | Nardone | 294/83 R |
| 3,239,266 | 3/1966 | Elliott | 294/78 R X |
| 3,268,967 | 8/1966 | Jordan | 294/82 R X |
| 3,393,001 | 7/1968 | Beckwith | 294/83 A |

FOREIGN PATENT DOCUMENTS

| | | | |
|---|---|---|---|
| 207077 | 1/1966 | Sweden | 294/78 R |

*Primary Examiner*—Johnny D. Cherry

*Attorney, Agent, or Firm*—Birch, Stewart, Kolasch and Birch

[57] ABSTRACT

A remote-controlled safety hook assembly which comprises a supporting frame, a hook-shaped member rotatably disposed within the supporting frame, spring-biased shackles suspended from the supporting frame, a drive element disposed in the supporting frame and a gear assembly operatively connected with the drive element and the hook-shaped member for automatically swinging the hook-shaped member from a closed position to an open position in response to a specified control signal.

31 Claims, 21 Drawing Figures

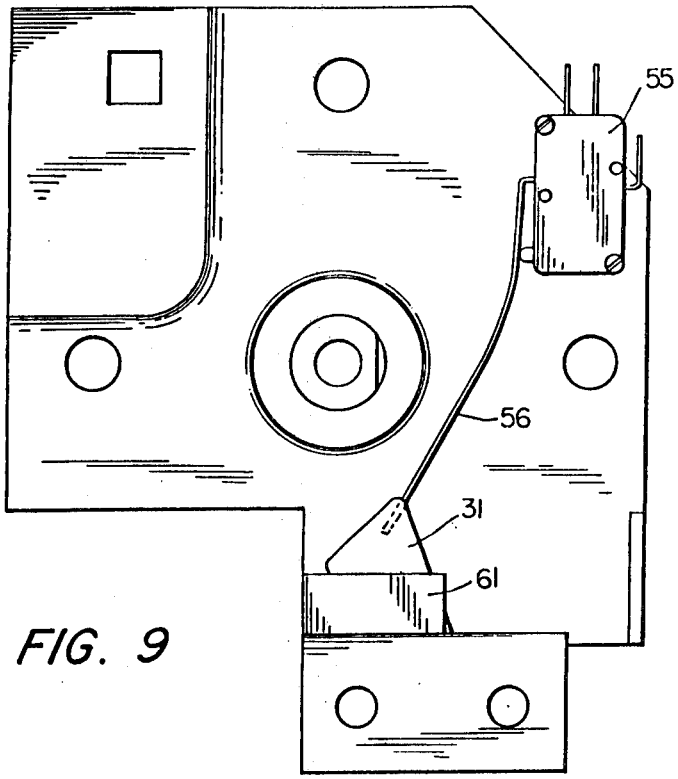
FIG. 9
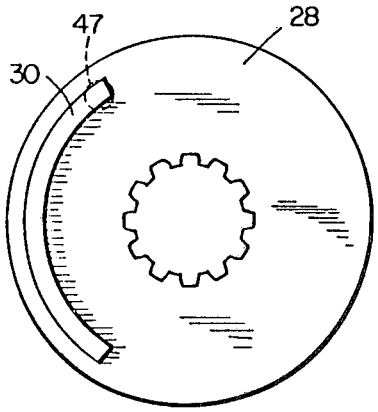
FIG. 10
FIG. 11
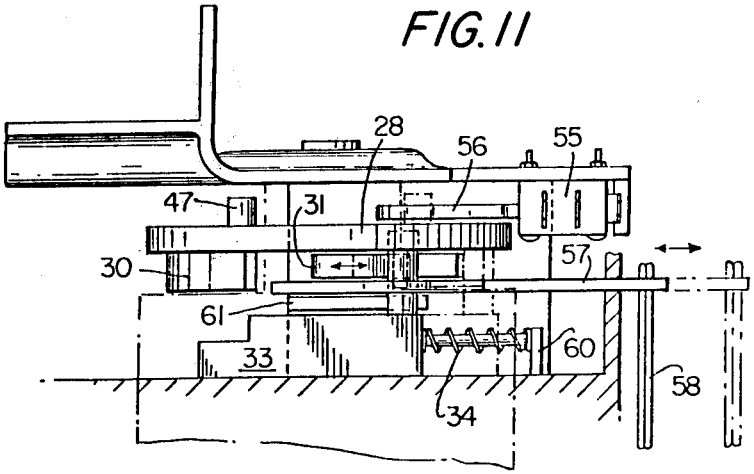

REMOTE-CONTROLLED SAFETY HOOK ASSEMBLY

BACKGROUND AND SUMMARY OF THE INVENTION

This is a continuation in part application of application Ser. No. 722,816 filed Sept. 13, 1976, now U.S. Pat. No. 4,073,531.

The present invention is directed to a remote-controlled safety hook which is used in moving heavy loads from one location to another. More particularly, the present invention is directed to a radio-controlled safety hook which contains certain safety features which, substantially eliminate the hazards normally associated with the movement of heavy loads in various types of construction operations.

When a crane is utilized for moving large, heavy loads from one location to another, for example, in various types of construction operations, at least one and frequently two workmen are utilized to guide the load into its proper position. Once the load has been positioned, one of the workmen must walk onto the load to unhook the choker from the load. In many instances, since the load is located many feet above the ground, for example in the case where the load is an I-beam which has been positioned in the superstructure of a building which is being constructed, the requirement that the workman walk onto the load to unhook the choker from the load creates a definite safety hazard to the worker. In addition to the safety hazard, a considerable amount of time is lost when the workman is required to perform such a duty.

In addition to the safety problems which presently exist in the prior art, hook-type devices which are used in conjunction with various loading, unloading, and relocating operations suffer from a number of deficiencies. For example, because of the very nature of the type of work being performed, the prior art hook-type remote-controlled devices are susceptible to damage because of the abuse which the hook must undergo during various types of constructional operation. The radio receiver and the relay are particularly sensitive to shock and thus, unless proper steps are taken to protect said devices against the shock which is normally associated with heavy construction operations, the lifetime of the remote-controlled hook will be seriously limited.

Accordingly, an object of the present invention is to eliminate all of the prior art deficiencies associated with remote-controlled hook devices which are utilized in relocating heavy loads from one location to another.

Another object of the present invention is to provide a system for automatically removing chokers from a load after the load has been properly positioned.

A further object of the present invention is to provide means for mounting various components of the safety hook of the present invention in order to protect them from shock.

Still another object of the present invention is to provide a safety hook wherein the hook itself can be manually released in the event of a malfunction in the operation of the device.

A still further object of the present invention is to provide a ratio-controlled safety hook wherein the hook is automatically locked when it is closed manually and will not open again until either the power is transmitted to the hook by a radio transmitter or the safety lock is manually operated to release the hook.

Yet another object of the present invention is to provide a safety hook assembly wherein the hook itself is readily accessible and free from interference with the shackles disposed on the device.

A still further object of the present invention is to provide a hook-shackle assembly wherein the shackles and the hook are independently supported by the frame through a common pin for producing a very strong and stable assembly.

Still yet another object of the present invention is to provide a safety hook assembly of sufficient weight so that it acts as a headache ball for overhauling the line from the drum of the hoisting equipment, thereby eliminating the need of a separate headache ball or weight.

Another object of the present invention is to provide a battery installation for the safety hook assembly which facilitates the ready introduction and removal of the battery from the safety hook when the battery becomes inoperative.

A still further object of the present invention is to provide a worm gear-motor hook assembly which provides for a smooth operation of the hook from a closed to an open position in response to a radio signal received by a radio receiver disposed on the safety hook assembly.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIG. 9 shows the operation of the pick-up switch disposed behind the motor;

FIG. 10 is a bottom view of a disk-like member which forms part of the master gear assembly;

FIG. 11 is a detailed profile view of the master gear assembly of the present invention;

DESCRIPTION OF THE PREFERRED EMBODIMENTS

Figure 1:
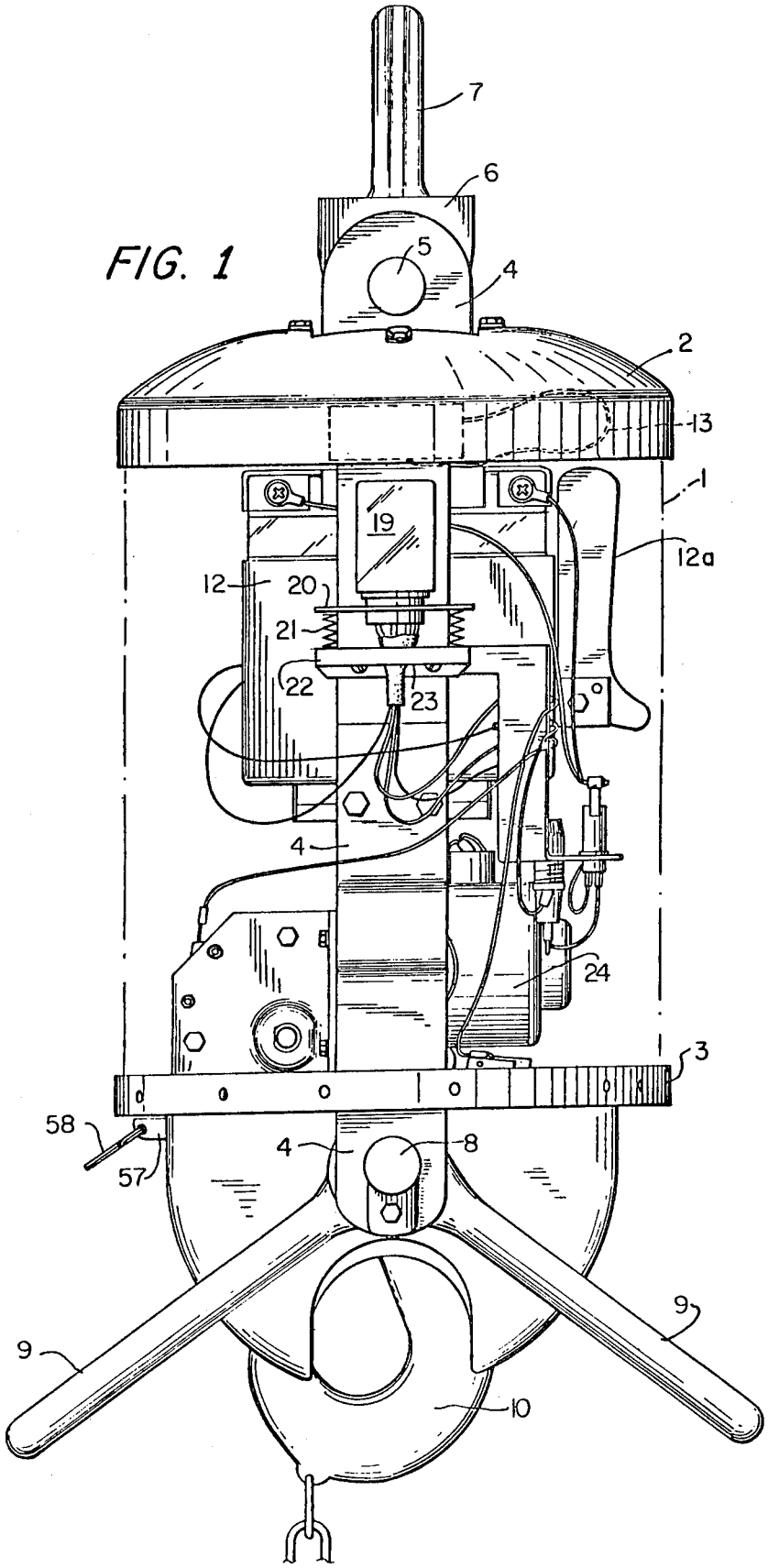
FIG. 1 is a front view of the radio-controlled safety hook of the present invention.

Referring now to the drawings, wherein identical reference numerals are used throughout the various views to indicate identical elements, the apparatus of the present invention, with particular reference to FIGS. 1–4, comprises a casing 1 including a hood portion 2 and a base portion 3. Frame members 4 are disposed between the base portion 3 and the hood portion 2 and extend through the hood and the base to provide overall support for the entire unit. The portion of the frame member 4 extending through the hood 2 is connected by a pin to a lifting support member 6 provided with an eye bolt 7. The pin 5 provides one-half of a universal connection with the lifting support member 6 so that the lifting support member can rotate clockwise and counterclockwise about the axis of the pin 5. On the other hand, the eye bolt 7 rotates in the horizontal direction, that is, perpendicular to the vertical axis of the device. Thus, in operation, the safety hook of the present invention can rotate freely in the horizontal plane and, in addition, can swing both clockwise and counterclockwise in the vertical plane. This, of course, provides great maneuverability when the safety hook of the present invention is under load.

The frame member 4 extending through the base portion 3 is connected by a support pin 8 to a pair of large shackles 9 and a hook 10. The shackles and the hook are freely movable about the support pin 8. The shackles are spring biased, and are symmetrically disposed about the hook so that in their relaxed, non-load state, they are open and do not interfere with accessibility to the hook. The shackles extend through the base 3 where they are connected to a coiled spring 11, which is tensioned so as to provide said spring bias to the shackles in their open, non-load position. The coiled springs are in turn connected to the frame member 4.

Figure 1A:
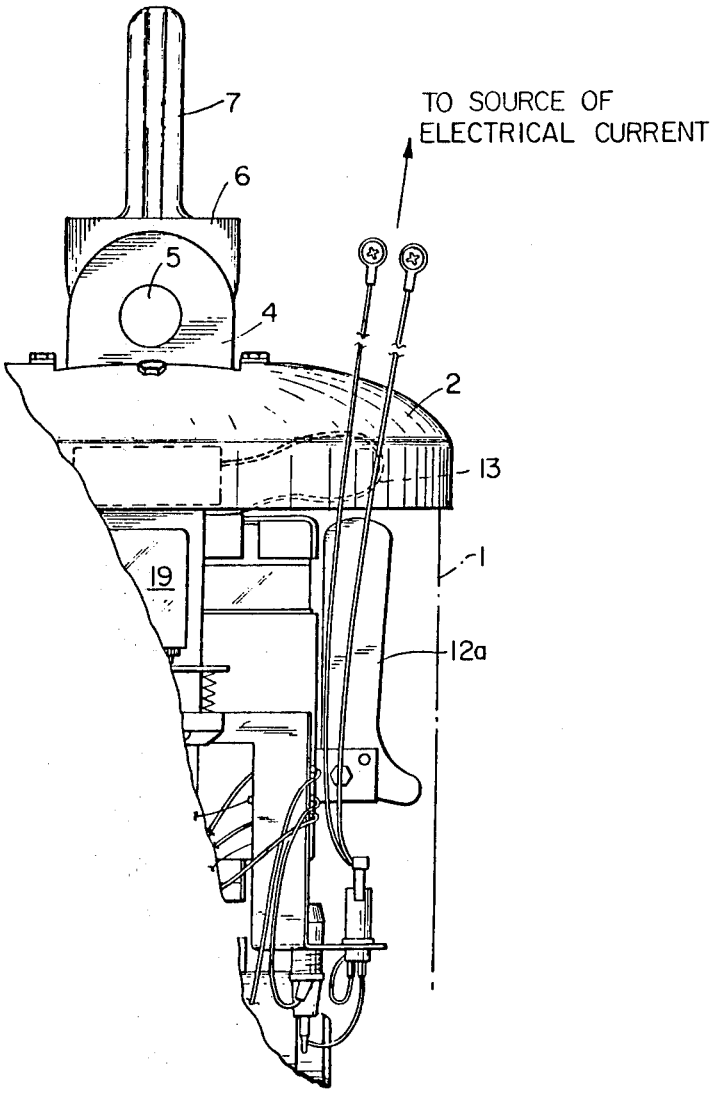
FIG. 1*a* shows the embodiment of the present invention wherein the safety hook obtains its electrical power from a ground source.
Figure 2:
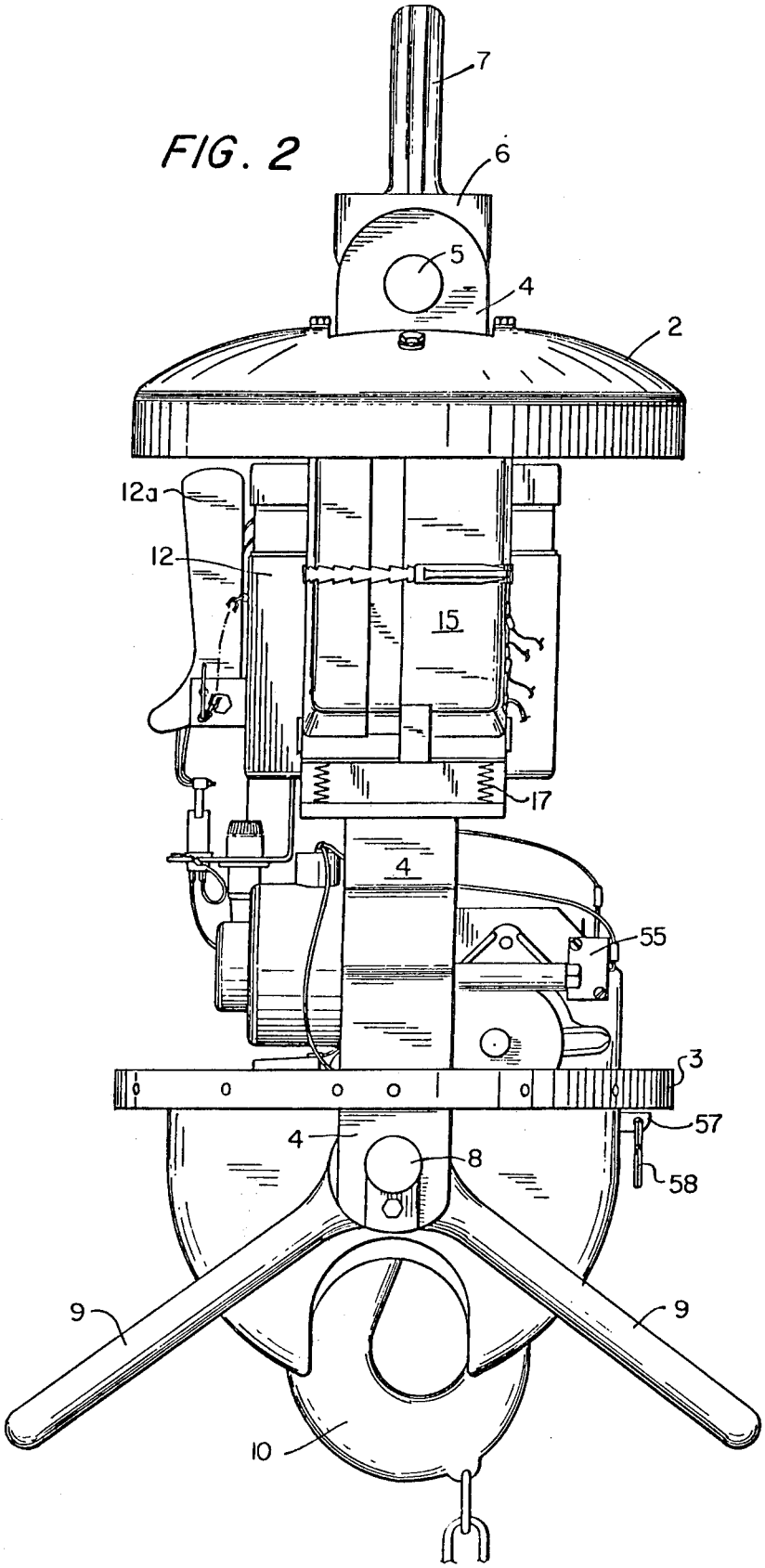
FIG. 2 is a rear view of the radio-controlled safety hook of the present invention.
Figure 3:
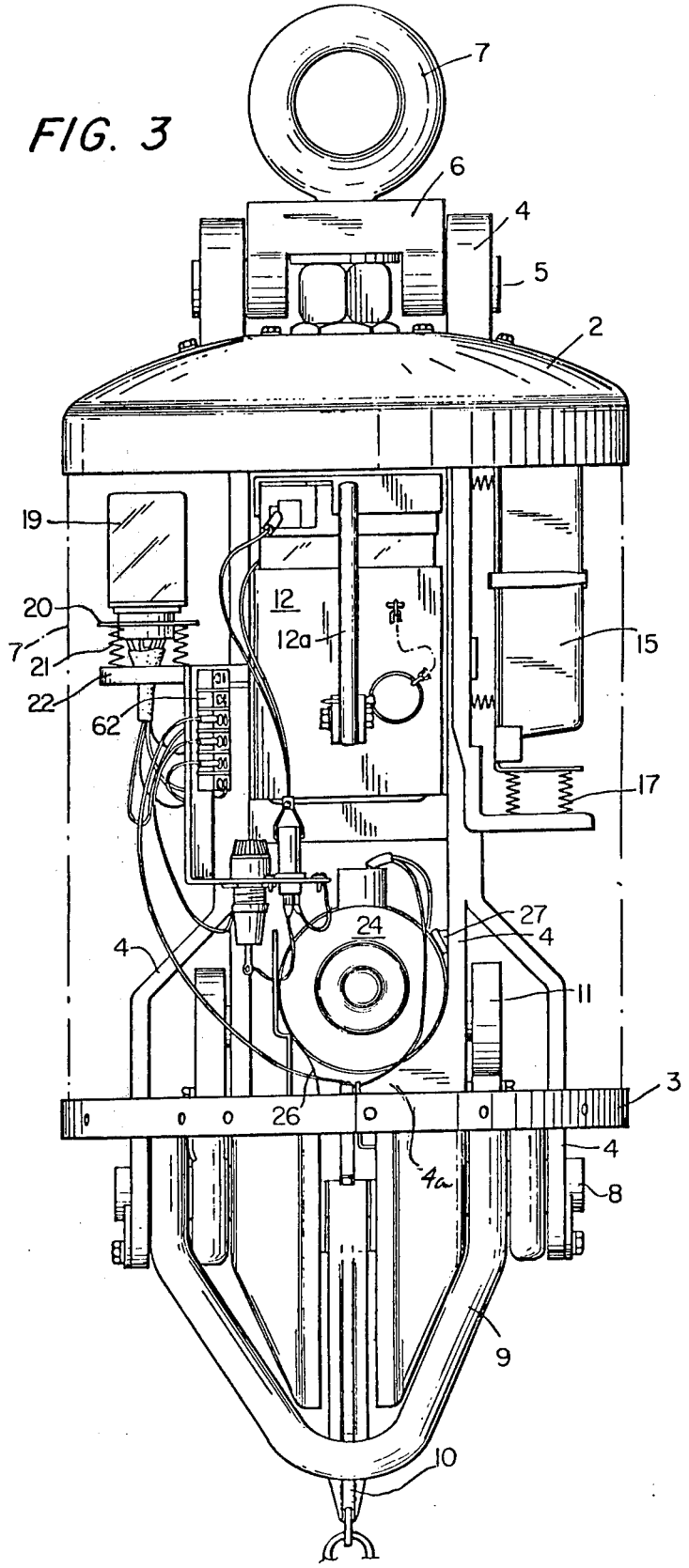
FIG. 3 is a right side view of the radio-controlled safety hook of the present invention.
Figure 4:
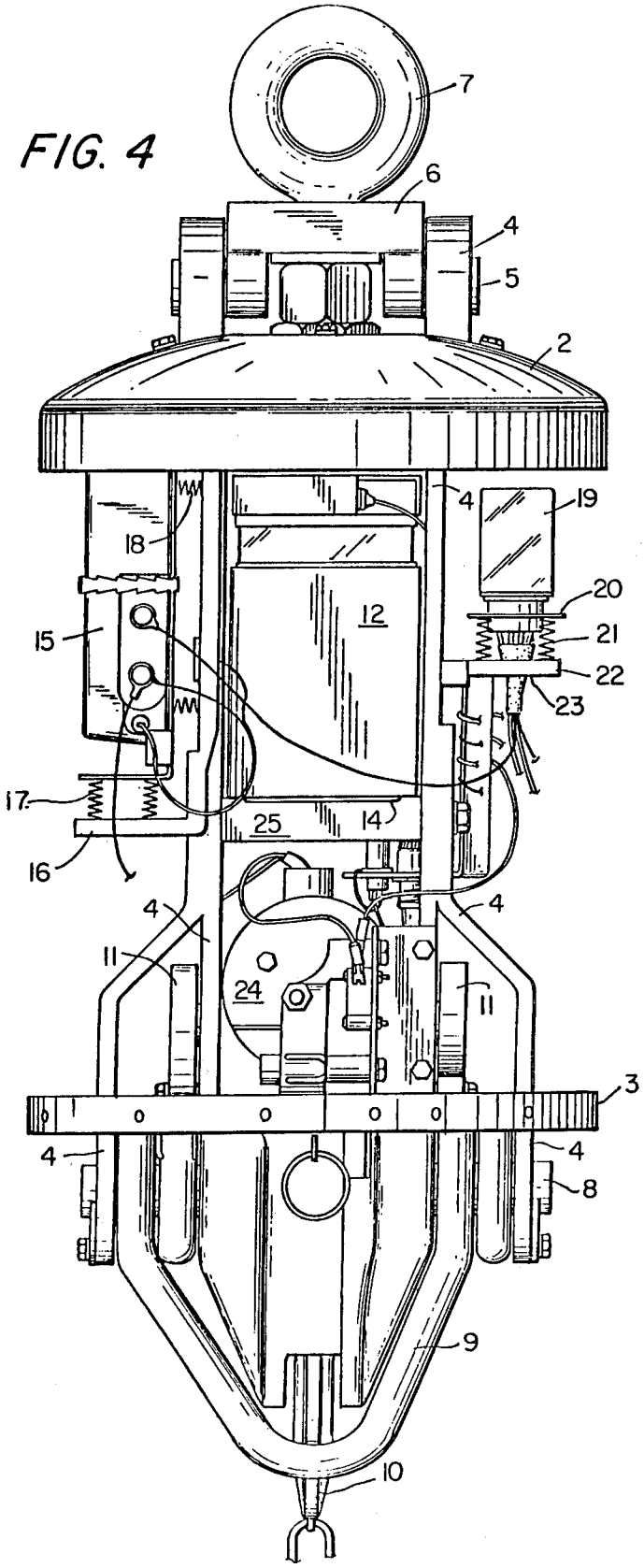
FIG. 4 is a left side view of the radio-controlled safety hook of the present invention.
Figure 5:
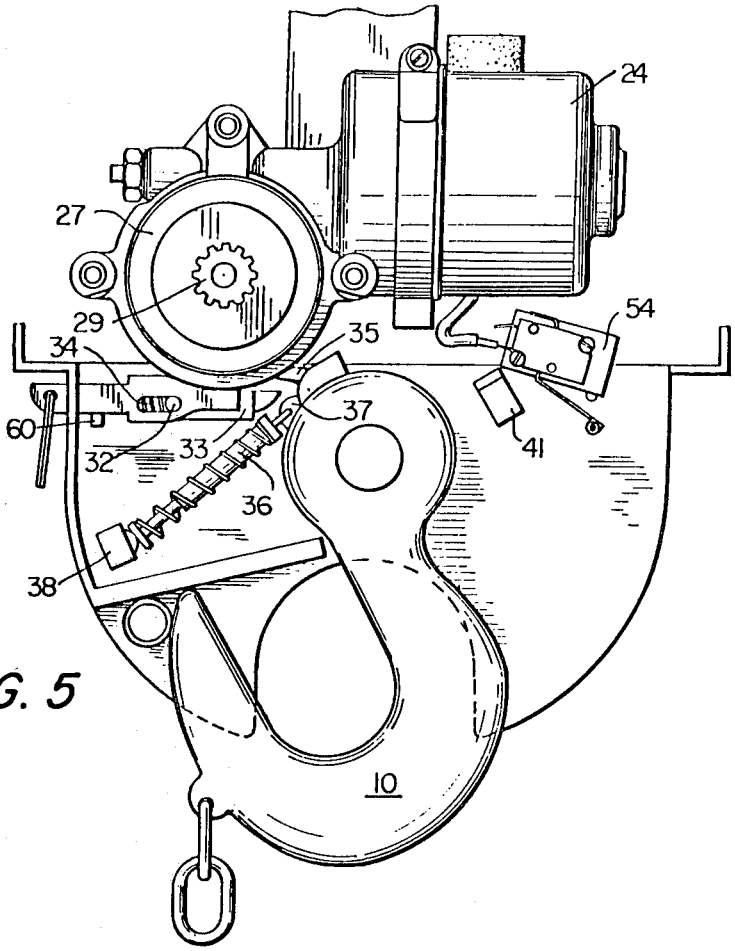
FIGS. 5–8 show the construction and operation of the master gear assembly and hook assembly of the present invention.
Figure 6:
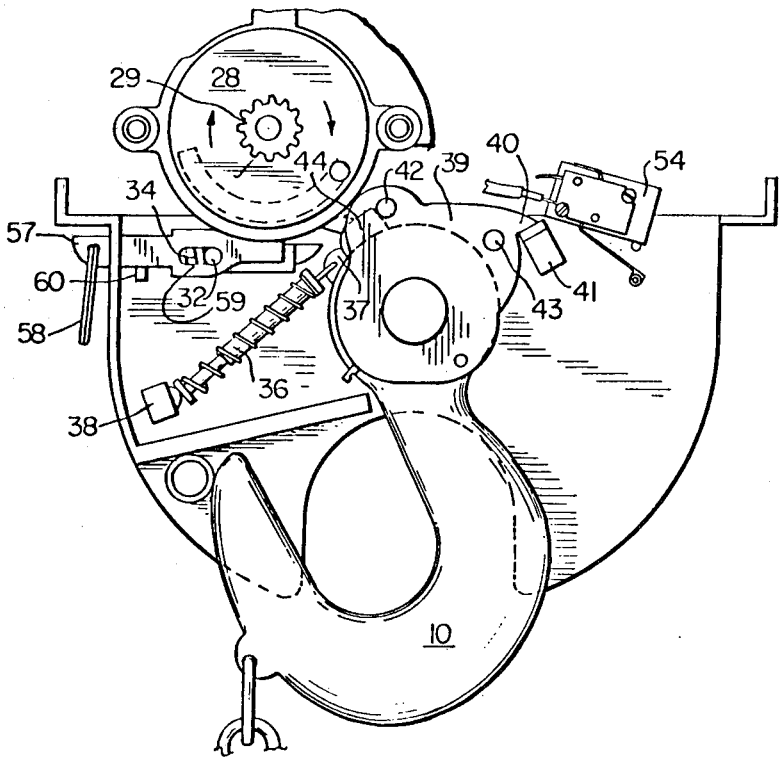
Figure 7:
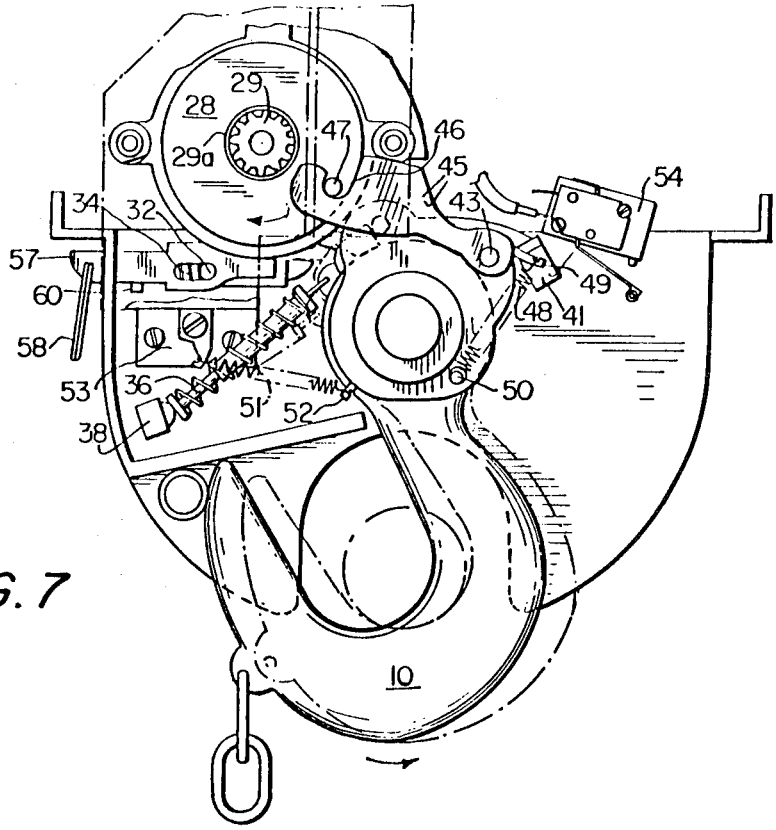
Figure 8:
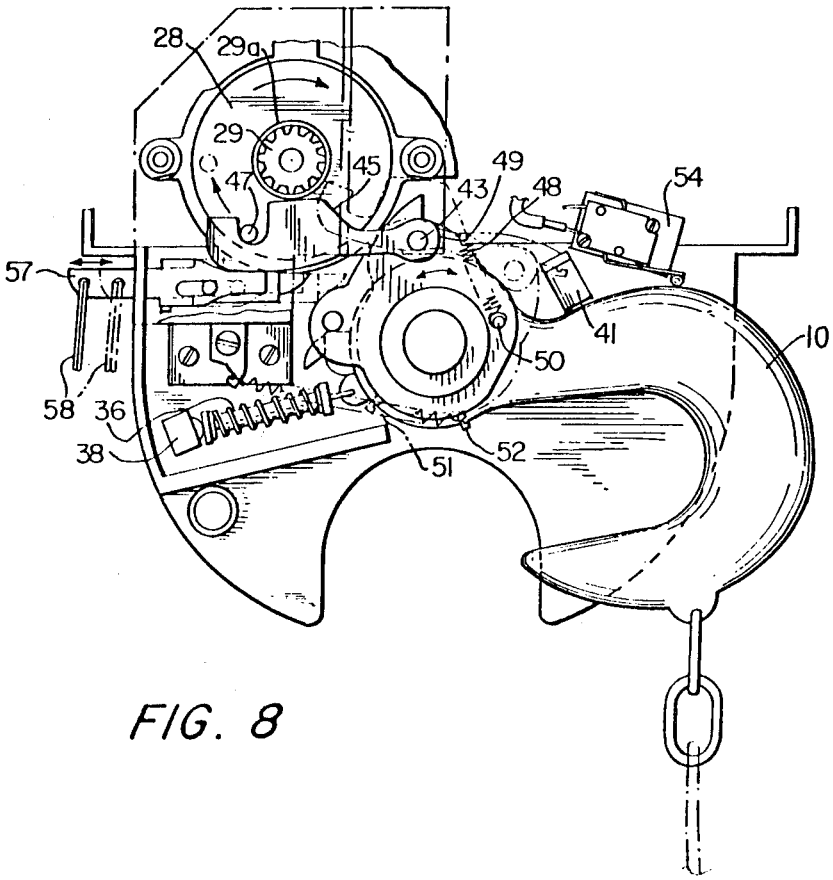

A battery, for example, a 12-volt battery, is utilized as the power supply for the safety hook of the present invention. The battery is disposed in a battery box 12 which is made of a strong metal such as steel. The battery box can be provided with a fold-up handle 12*a* which can be held in an extended position from the battery box by a pin. Thus, the battery is inserted into the battery box and with the assistance of the fold-up handle, the battery box is inserted in the frame members 4 of the safety hook and held in position in the frame members by a spring 13 advantageously fastened to the frame 4 disposed beneath the hood. The spring 13 functions to compress and hold the battery box in position within the frame. The bottom of the battery box is also provided with two substantially parallel ridges 14 which extend from the bottom of the battery box and straddle a portion of the supporting frame for holding the battery box stationary within the frame. Alternatively, the battery can be dispensed with and in this embodiment as shown in FIG. 1*a* electrical cables extend from the safety hook to a source of electricity on the ground.

A radio receiver 15 is spring mounted to a radio receiver frame 16 which, in turn, is secured to the support frame 4. The radio receiver frame 16 is provided with springs 17 and 18 to cushion the radio receiver against vertical and horizontal shock movements, respectively.

A relay 19 is similarly spring mounted to the other side of the support frame 4. The relay 19 is attached to a plate 20 which is held in position by springs 21 which are attached to a table 22 which is fixed to the support frame 4. An aperture 23 is provided in said table and the electrical connections for the relay extend through said aperture for connection with the various elements of the unit.

The frame 4 also supports a motor 24, for example, a 12-volt motor provided with a worm gear, which is separated from the battery by an intermediate frame member 25. The motor is cradled from below in a motor mount 4*a* which extends from the frame 4 and follows the curvature of the motor. A screw clamp 26 generally extends over the top surface of the motor and is fixed at one end to the motor mount and at the other end thereof to a stud 27 which, in turn, is secured to the frame 4. Thus, by tightening the screw clamp 26, the motor is held firm between the screw clamp on the top of the motor and the motor mount at the bottom of the motor.

FIGS. 5–8 show the construction and operation of the master gear assembly and the hook assembly of the safety hook of the present invention. In referring to FIGS. 5–8, it can be seen that the motor 24 drives a master gear 27 which is mounted to the motor. A disk-like member 28 is mounted for rotation on a cog member 29. The disk-like member is provided with a ridge 30 which extends inward toward the master gear for engagement with a lever 31 (see FIGS. 9 and 11) which is adapted to ride on the ridge 30. As the ridge 30 engages the lever 31, it pushes said lever into contact with a pin 32 which is attached to a safety lock 33. The safety lock 33 is, in turn, released, against the spring action of spring member 34, free from contact with dog 35 attached to the top portion of the hook, thereby releasing the hook for movement in the counterclockwise direction in response to radio signals.

A spring element 36 is attached at one end to a lug 37 which is secured to the top of the hook. At the other end, the spring element is attached to a ball socket which in turn is secured to the frame 4. The spring element 36 functions to hold the hook either in an open or closed position.

A plate member 39 is mounted on the same support pin 8 which holds and supports the shackles and the hook. The plate member is provided with a tooth 40 which engages the stop 41 attached to the frame for limiting the movement of the plate member 39. The plate member is provided with a peg 42 and a peg 43 which extend inwardly and outwardly, respectively, from the plate member 39. The peg member 42 is provided for engagement with the tooth 44 attached to the top of the hook. The connecting rod 45 is attached at one end to the peg 43 and is provided at the other end with a notch 46 which is adapted to engage with pin 47 which extends from the top of the disk-like member 28. A spring 48 is attached at one end to an extension 49 of the connecting rod 45 and is attached at the other end to a nipple 50 extending from the plate member 39. The spring 48 holds tension on the connecting rod 45 for engagement with the pin 47. An additional spring 51 is secured at one end to a pin 52 attached to the plate member 39, and at the other end to the mounting frame 53 for the master gear. The spring 52 holds tension on the plate member 39 so that when the pin 47 on the disk-like member 28 disengages from the slot 46 in the connecting arm 45, due to the continuing rotation of the plate, the spring pulls the plate member 39 clockwise back to a starting position against stop 41. Thus, with the hook in the open position, the device is now ready for reloading. The stop 41 also acts to limit the extent of the opening of the hook by engaging with the back of the hook. To facilitate disengagement of the connecting rod 45 from the pin 47, the cog member 29 is provided with a ring **29*a*** which acts as a cam to disengage said connecting rod from said pin.

When the hook opens to its maximum position by striking the stop 41, it also, at the same time, contacts a cut-off switch 54 which cuts off all electrical power to the hook. When the power to the cut-off switch 54 is cut off, the switch 55 is energized and makes contact through switch arm 56 to pin 47. The electrical energy supplied to pin 47 causes the disk-like element 28 to continue to rotate until the connecting rod 45 disengages from the pin 47. At this point, the spring 51 which is attached to plate member 39 causes said plate member to rotate clockwise. Since the control arm is connected to the plate member, both are returned to their initial starting positions due to the action of the spring member. At the same time, as soon as the ridge portion 30 becomes disengaged from the lever 31, the safety lock 33 springs back to engagement with the top portion of the hook. The safety lock is now in a ready position to lock when the hook is closed. Thus, as the hook is manually closed, the safety lock rides on the top portion of the hook until it finally engages in a locking position with dog 35.

Element 57 is a bar attached to the safety lock, said bar being provided with a ring 58 which facilitates manually releasing the safety lock. Thus, in the event of a malfunction in the operation of the hook, the safety lock can be manually retracted to open the hook. The bar 57 contains a slot 59 through which the pin 32 can move during the automatic operation of the hook. the spring 34 of the safety lock 33 is supported by a spring support member 60 as shown in FIG. 11. Also, a keeper 61 for supporting the key is shown in FIG. 9. FIG. 10 shows the underside of the disk-like member 28 provided with a ridge 30. The pin 47 which extends from the top side of the disk-like member 28 for engagement with the connecting rod 45 is shown in phantom in FIG. 10.

The electrical components used in the radio-controlled safety hook of the present invention are well known in the art and do not form part of the present invention. Basically, when it is desired to operate the safety hook, a radio frequency is transmitted to the radio receiver disposed on the supporting frame of the safety hook. The radio receiver, in turn, energizes a relay which activates the motor, thereby initiating the operation of the hook. Element 62 is an electrical distributing block for controlling and transferring the electrical connections to various components of the system.

The operation of the safety hook of the present invention will now be described with particular reference to FIGS. 12–14 of the present application. In referring to FIG. 12, a choker 63 is choked around a beam 64 by drawing the choker through an eye 65 made in the end portion of the choker. The other end portion of the choker is attached to the hook by a similar eye 66. A small shackle 67 is then hooked through the eye 65 and also through the eye 68 of another choker 73 using a screw pin 69. The second choker is provided at its other end with another eye 70. This eye is connected to the large spring-biased shackle 9 by a small shackle 71 provided with a fastening pin 72. As can be noted in FIG. 12, the choker 73 is in an untensioned state because the entire weight of the beam or load 64 is borne by the choker 63. However, the choker 73 provides the very valuable function of retrieving the choker 63 after it has been released from the hook as discussed hereinbelow.

Figure 12:
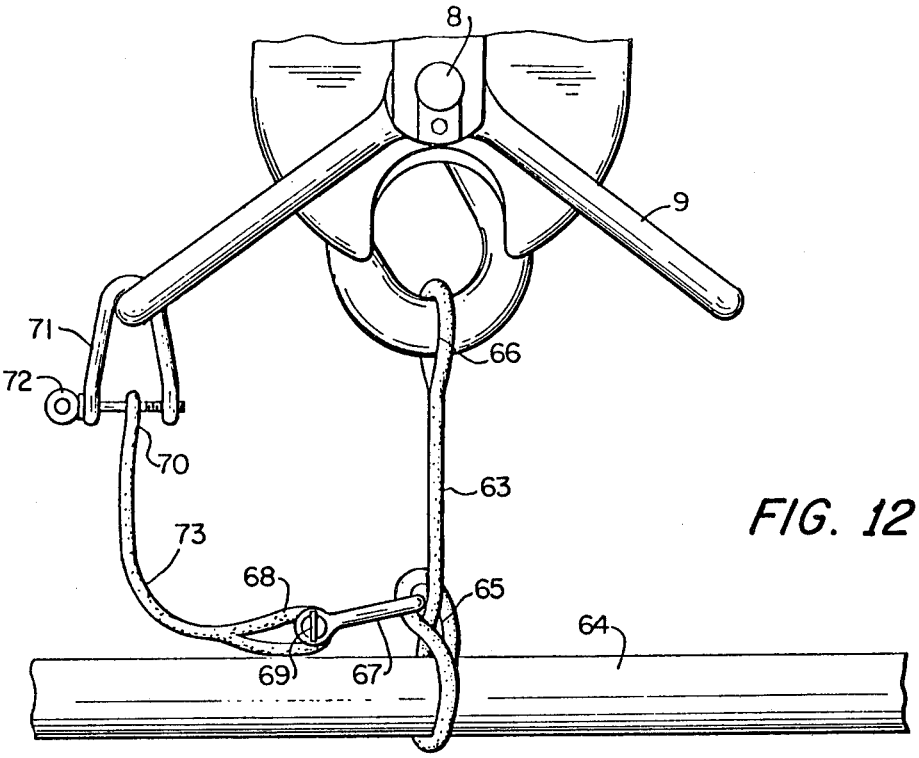
FIG. 12 shows a single choker arrangement wherein the entire weight of the load is borne by a single choker extending from the hook to the load.

Once the load is properly shackled as shown in FIG. 12, the hook, which is spring-biased in its open position, is manually closed. The load is then lifted to a desired location. In positioning the load, effective use is made of both the universal connection and the rotational movement of the eye bolt 7. After the load is properly positioned, two men at opposite ends of the load place and secure the load. Once the load is in place and the load is off the hook, the transmitter is activated, which sends a radio signal of specified frequency to the radio receiver disposed on the safety hook. The radio receiver activates the relay which steps up the amperage for operating the motor. Through the operation of the motor, the hook opens against its spring bias in the manner shown in FIGS. 7 and 8. The opening of the hook releases the eye 66 of the choker from the hook. The choker 63 is, in turn, threaded through its eye 65 at the other end thereof and this frees itself from the load 64. The choker 63 is then retrieved by the choker 73 because said chokers are connected together by the small shackles 69. This particular sequence eliminates the necessity of a workman walking out onto the load to unhook the choker from the load. This, of course, provides a definite safety feature of the safety hook of the present invention when compared to the prior art devices.

Figure 13:
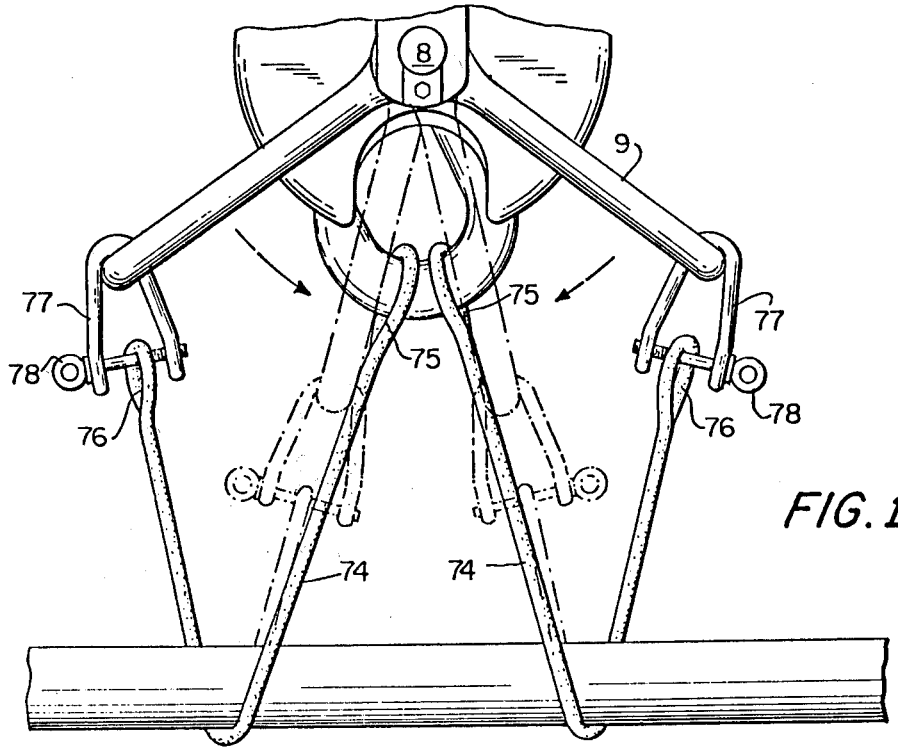
FIG. 13 shows a double choker arrangement wherein the load is cradled by the chokers and the weight of the load is shared by the chokers extending from the hook and the chokers extending from the large spring-biased shackles.

FIG. 13 shows another embodiment of the choker arrangement of the present invention wherein a double shackle and cradle hitch arrangement is utilized for supporting and transferring the load. As shown in FIG. 13, two identical chokers 74 containing eyes 75 at one end thereof and eyes 76 at the other end thereof are utilized. The eyes 75 are attached to the hook and the eyes 76 are attached to the smaller shackles 77 by a screw pin 78. The smaller shackles are in turn connected to the larger spring-biased shackles 9. In this particular embodiment, each of the four lengths of choker extending from the hook and the smaller shackles, respectively, to the load carry an equal proportion of the weight of the load. When the load is applied to the hook, the spring shackles and the chokers reposition themselves in the manner shown by the phantom lines.

Figure 14:
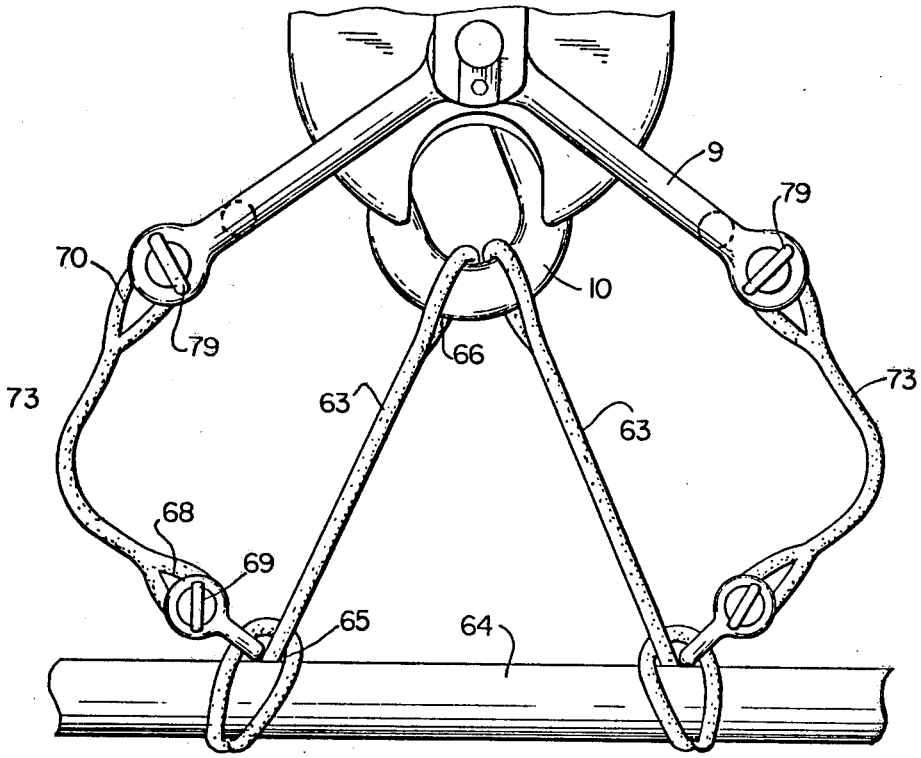
FIG. 14 shows an embodiment similar to FIG. 12 wherein a double shackle arrangement is utilized in place of a single shackle arrangement.
Figure 15:
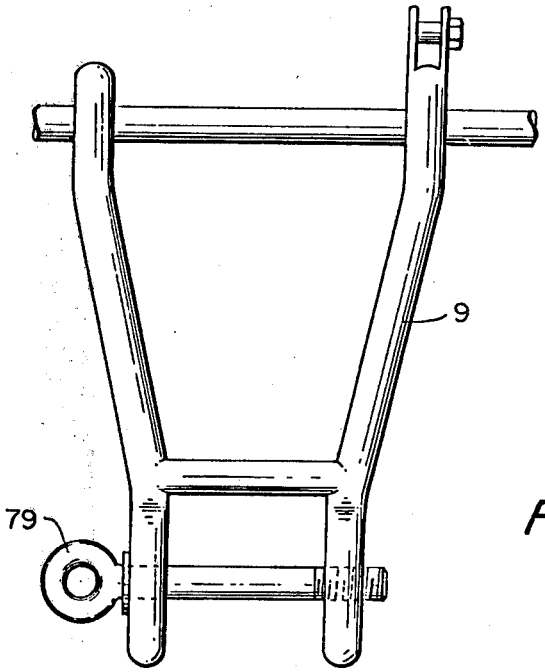
FIG. 15 shows a further embodiment of the design of the large spring-biased shackles used in the safety hook of the present invention.

FIG. 14 is somewhat similar to FIG. 12 in that the choker arrangement is the same. However, FIG. 14 shows the use of a double choker arrangement which utilizes both of the large, spring-biased shackles. In addition, the design of the spring-biased shackles has been modified as shown in FIG. 15 as double shackles with a screw pin 79 being utilized for connecting the eye of the chokers directly to the spring-biased shackles.

Figure 16:
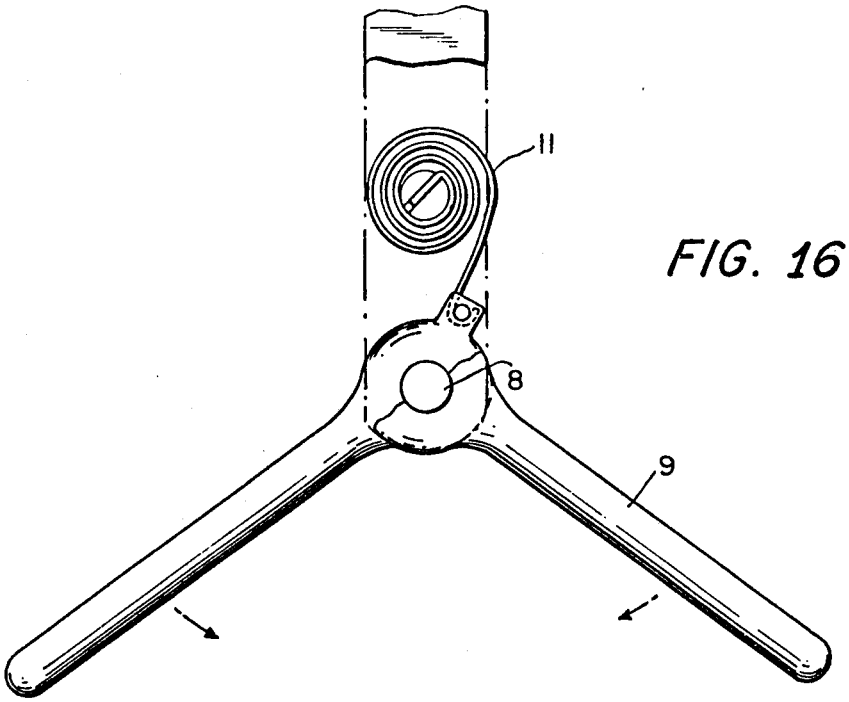
FIG. 16 shows the large spring-biased shackles in a non-load position.
Figure 17:
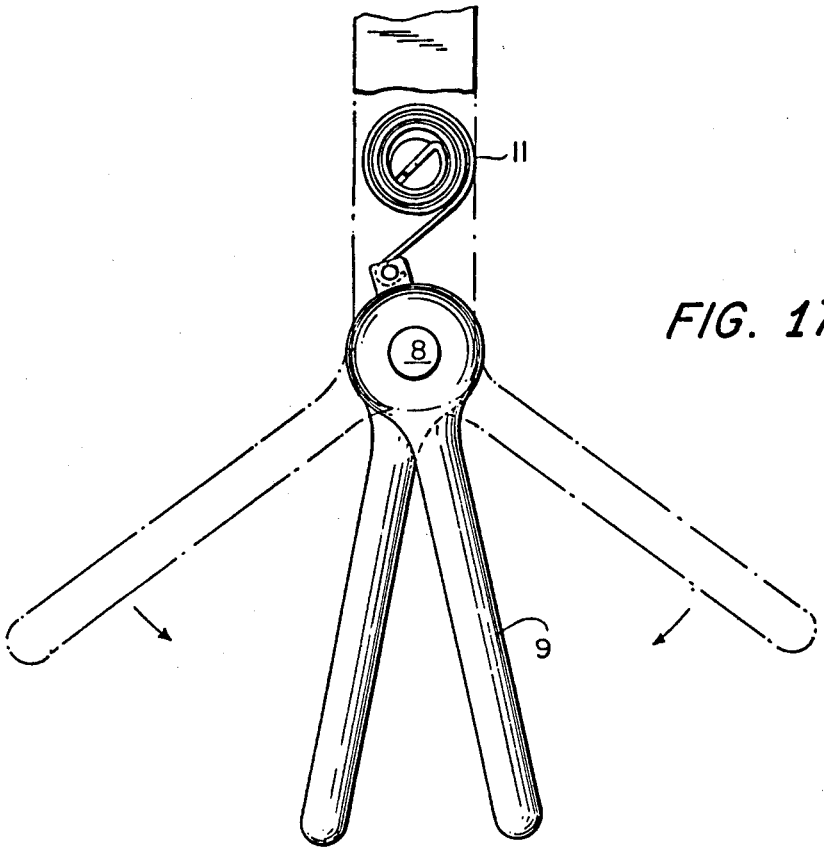
FIG. 17 shows the large spring-biased shackles of the present invention in a load position.

FIGS. 16 and 17 show how the large shackles are spring-biased by the coil spring 11. FIG. 16 shows the shackles in a non-load position, and FIG. 17 shows the position assumed by the shackles under a load condition.

Figure 18:
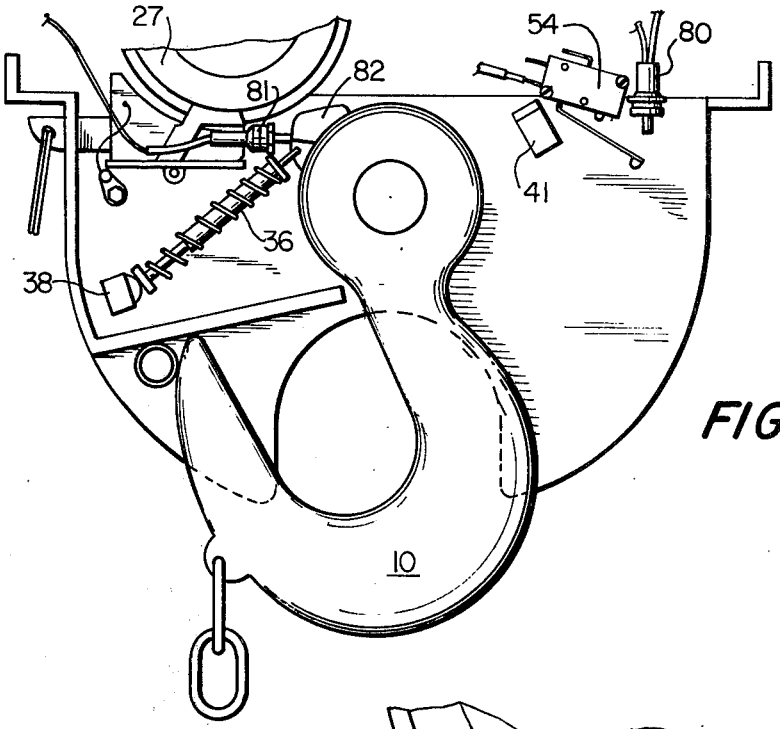
FIGS. 18 and 20 show the cooperation of the hook-shaped member and a close switch, as the hook-shaped member moves from a closed to an open position, for preventing possible damage to the receiver and/or the relay and/or power supply.
Figure 20:
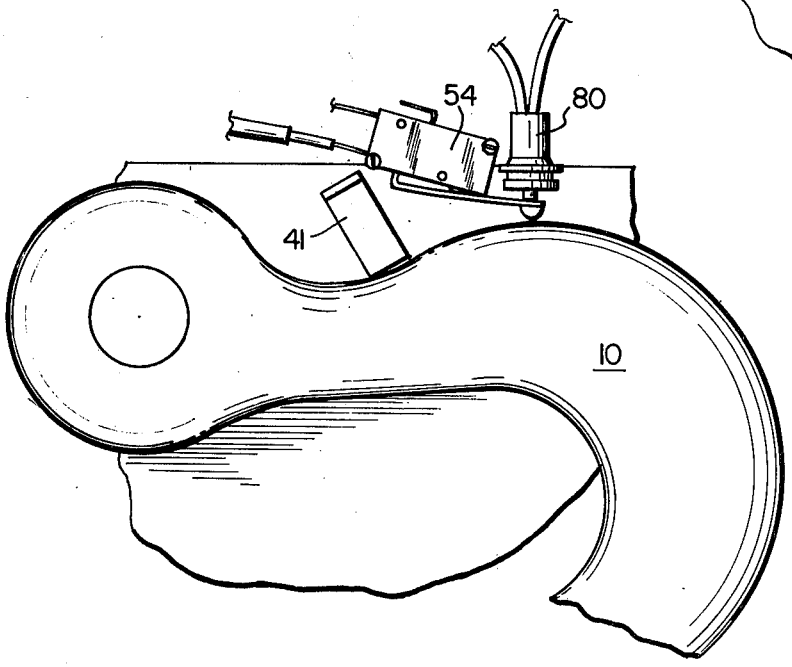

In a further embodiment of the present invention a close switch 80 which communicates directly with the receiver and the battery is disposed adjacent to cut-off switch 54, as shown in FIG. 18, so that when the hook-shaped member swings to a full open position, as shown in FIG. 20, it not only engages switch 54 but also engages the close switch 80 thereby cutting off all power to the hook-shaped member. The close switch 80 provides a protection for the receiver and the relay because if the close switch 80 is not provided, the receiver and the relay would remain in an operative state so that if the transmitter is operated by an operator, it would draw power from the battery and could damage the receiver and/or the relay. Thus when the hook is open, it engages both the cut off switch and the close switch 80 which cuts off power to the motor and to the transmitter, respectively.

Figure 19:
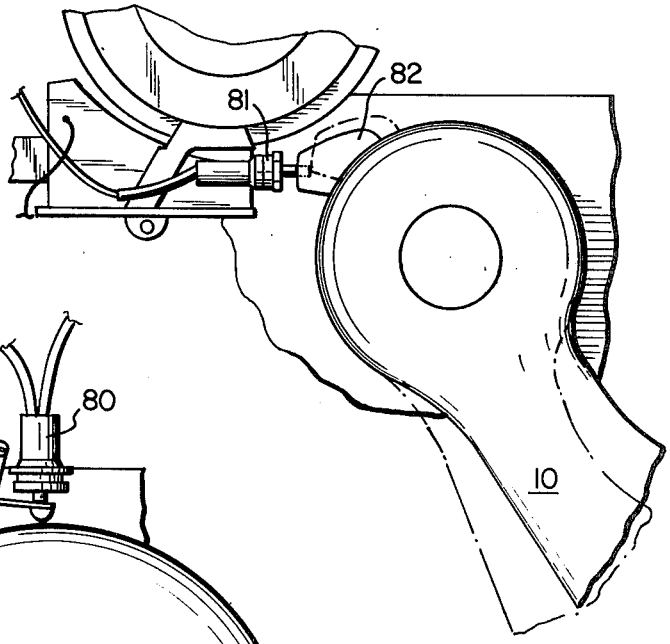
FIG. 19 shows the use of a load safety switch in cooperation with a cam attached to the top of the safety hook-shaped member for preventing accidental opening of the hook-shaped member when the hook-shaped member is under load.

In still a further feature of the present invention a load safety switch 81 is attached to the safety lock for engagement with a lug 82 which is located at the top of the safety hook-shaped member and extends therefrom. Thus when a load is attached to the hook-shaped member, the hook-shaped member shifts its position from the solid line to the dot-dash-dot line as shown in FIG. 19, which causes the lug 82 to engage the load safety switch 81 thereby cutting off all power to the receiver and the relay through the use of the load safety switch, accidental opening of the hook-shaped member is prevented when the hook is under load. Also, excessive strain on the motor is eliminated. When the load is released, the hook-shaped member shifts back to its original position causing the lug 82 to be disengaged from the load safety switch 81, thereby restoring power to the hook-shaped member.

The safety hook device of the present invention has the following advantageous features:

1. The chokers can be automatically removed from the hook as described hereinabove, thereby eliminating some of the hazards associated with the prior art devices.

2. The radio receiver and the relay systems forming part of the safety hook assembly of the present invention are spring-mounted so as to protect them from the shock normally associated with heavy equipment operation.

3. The safety hook assembly of the present invention is provided with a safety lock which can be manually released, thereby releasing the hook in the event of a malfunction in the overall operation of the device.

4. The safety hook assembly of the present invention functions to automatically lock the hook when it is manually closed and said hook will not open again until either the power is transmitted to the receiver disposed in the hook assembly by a radio transmitter or the hook is manually opened.

5. The main shackles forming part of the hook assembly of the present invention are spring-biased in an open or extended position so that the hook itself is readily accessible and free from said shackles attached to the device. The spring-biased arrangement of the shackles is particularly advantageous in that when the shackles are used in conjunction with the hook to support a load, the shackles move to a position so that they are in direct alignment with the chokers much in the manner shown in FIG. 13 of the present application. This particular feature of the present invention avoids any possible bending of the shackles when they are exposed to a substantial load. Also, when the spring-biased shackles move against the spring bias to a position in line with the chokers, a much larger load can be borne by the chokers.

6. In a further feature of the present invention, a hook-shackle assembly is provided wherein the shackles and the hook are independently supported by the frame through a common pin for producing a very strong and stable assembly.

7. The safety hook assembly of the present invention inherently contains sufficient weight so that it reacts as a headache ball for overhauling the line from the drum of the hoisting equipment, thereby eliminating any need for a separate headache ball or weight.

8. The battery utilized in the safety hook assembly of the present invention is advantageously housed in a battery box which can be readily inserted into or removed from the hook assembly. The battery box is provided with a snap-up handle which is in a raised position against the battery box when it is disposed in the safety hook assembly, but which can be readily extended and held in place by a pin when it is desired to replace the battery when it becomes defective. As mentioned hereinabove, the battery case is provided with parallel ridges on the bottom thereof which bridge a portion of the frame member when it is disposed within the frame of the hook assembly. In addition, a spring is also attached to the supporting frame for holding the battery in position within the hook assembly. Thus, such an arrangement readily facilitates the removal of the battery from the overall device when desired.

9. The safety hook assembly of the present invention is also provided with various switch members for cutting off all power to the hook-shaped member and to the receiver and the relay during certain operational procedures. These features prevent possible damage to the receiver and/or relay, accidental opening of the hook-shaped member and excessive strain on the motor.

As previously stated, once the hook is closed, it is locked into place by the safety catch and cannot be opened unless the catch is pulled out manually or the radio control is activated. However, the radio transmitter and receiver will not operate when the load is on the hook, and there is no way to disconnect the load from the hook until it is safely positioned.

Although the battery is the preferred source of electrical power utilized in the safety hook assembly of the present invention, it is readily apparent that other sources of electrical power to the hook assembly can be utilized, such as for example, an electrical cable. However, when using the latter, special precaution must be taken to avoid a possible short circuit and electrically energizing the hook.

Although in the preferred embodiment of the present invention two shackles are utilized, it is readily apparent that a single shackle or more than two shackles might be utilized which may or may not be spring biased. It is also preferred that the shackles be spring biased so that when a load is placed on the hook-shaped member, the shackles function to increase the load-carrying capacity of the safety hook assembly. Thus, as shown in FIG. 13, as the load is assumed by the hook-shaped member, the spring-biased shackles move from their lateral position to a substantially vertical position relative to the load, thus substantially doubling the load-carrying capacity of the safety-hook assembly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A remote-controlled safety hook assembly which comprises a supporting frame, a hook-shaped member rotatably disposed within said supporting frame, at least one shackle means suspended from said supporting frame, a power supply means disposed in said supporting frame, a receiver means for receiving specified control signals disposed in the supporting frame and a relay means operatively connected with the receiver means, drive means disposed in said supporting frame, a gear assembly operatively connected with said drive means and said hook-shaped member for automatically swinging said hook-shaped member from a closed position to an open position in response to specified control signals and a cut-off switch means and a close switch means disposed for engagement with the hook-shaped member in its open position, both of said switch means releasing all electrical power to said hook-shaped member when the hook-shaped member is open and said close switch means simultaneously disengaging the receiver means and the relay means from the hook-shaped member, thus preventing possible damage to said receiver means, said relay means and said power supply means.

2. The remote-controlled safety hook assembly of claim 1, wherein the power supply means is a battery.

3. The remote-controlled safety hook of claim 1, wherein the safety hook assembly contains two shackles.

4. The remote-controlled safety hook assembly of claim 1, which further comprises a lug means attached to said hook-shaped member, and a load safety switch disposed for engagement with said lug means so that when the hook-shaped member is placed under load, the lug means engages the load safety switch thereby eliminating all power to the hook-shaped member.

5. The remote-controlled safety hook of claim 4, wherein the shackle means is spring biased.

6. The remote-controlled safety hook of claim 5, wherein the spring-biased shackle means has a substantially U-shaped configuration with the free ends of said shackle means being rotatably connected to the supporting frame.

7. The remote-controlled safety hook of claim 4, wherein the shackle means is spring biased and extends laterally with respect to the hooked-shaped member, said shackle means being rotatably suspended from the supporting frame.

8. The remote-controlled safety hook of claim 7, wherein two spring-biased shackles are utilized.

9. The remote-controlled safety hook of claim 4, wherein the gear assembly contains a safety lock mounted therewith and a disk-like element, said disk-like element being mounted for rotation in response to the drive means, and being provided on one side thereof with means for disengaging the safety lock for releasing the shaped hook-member for counterclockwise movement.

10. The remote-controlled safety hook of claim 9, wherein the safety switch is attached to the safety lock for engagement with said lug means.

11. The remote-controlled safety hook of claim 9, wherein the disk-like element is provided with a pin means on the other side thereof and the hook-shaped member is provided with a connecting arm which is adapted to engage and disengage with said pin means in response to the rotation of said disk-like element, said hook-shaped member moving from a closed to an open position during said movement.

12. The remote-controlled safety hook of claim 9, wherein an additional switch means is operatively associated with the gear assembly and is mounted for providing continual rotation of the disk-like element, thereby releasing the safety lock to a position for locking the hook-shaped member when said member is manually closed.

13. The remote-controlled safety hook of claim 4, wherein spring means are operatively associated with the hook-shaped member for holding the hook-shaped member in either an open or closed position.

14. The remote-controlled safety hook of claim 1, wherein the shackle means is spring biased.

15. The remote-controlled safety hook of claim 14, wherein the spring-biased shackle means has a substantially U-shaped configuration with the free ends of said shackle means being rotatably connected to the supporting frame.

16. The remote-controlled safety hook of claim 1, wherein the shackle means is spring biased and extends laterally with respect to the hooked-shaped member, said shackle means being rotatably suspended from the supporting frame.

17. The remote-controlled safety hook of claim 16, wherein two spring-biased shackles are utilized.

18. The remote-controlled safety hook of claim 1, wherein the gear assembly contains a safety lock mounted therewith and a disk-like element, said disk-like element being mounted for rotation in response to the drive means, and being provided on one side thereof with means for disengaging the safety lock for releasing the hook-shaped member for counterclockwise movement.

19. The remote-controlled safety hook of claim 18, wherein the disk-like element is provided with a pin means on the other side thereof and the hook-shaped member is provided with a connecting arm which is adapted to engage and disengage with said pin means in response to the rotation of said disk-like element, said hook-shaped member moving from a closed to an open position during said movement.

20. The remote-controlled safety hook of claim 18, wherein an additional switch means is operatively associated with the gear assembly and is mounted for providing continual rotation of the disk-like element, thereby releasing the safety lock to a position for locking the hook-shaped member when said member is manually closed.

21. The remote-controlled safety hook of claim 1, wherein spring means are operatively associated with the hook-shaped member for holding the hook-shaped member in either an open or closed position.

22. A remote-controlled safety hook assembly which comprises a supporting frame, a hook-shaped member rotatably disposed within said supporting frame, a lug means attached to said hook-shaped member, two shackle means suspended from said supporting frame, drive means disposed in said supporting frame, a gear assembly operatively connected with said drive means and said hook-shaped member for automatically swinging said hook-shaped member from a closed position to an open position in response to specified control signals, and a load safety switch disposed for engagement with said lug means so that when the hook-shaped member is placed under load, the lug means engages the load safety switch, thereby eliminating all power to the hook-shaped member.

23. The remote-controlled safety hook of claim 22, wherein the shackle means are spring biased.

24. The remote-controlled safety hook of claim 23, wherein the spring-biased shackle means have a substantially U-shaped configuration with the free ends of said shackle means being rotatably connected to the supporting frame.

25. The remote-controlled safety hook of claim 22, wherein a power supply means is disposed in said supporting frame.

26. The remote-controlled safety hook of claim 22, wherein the shackle means are spring biased and extend laterally with respect to the hook-shaped member, said shackle means being rotatably suspended from the supporting frame.

27. The remote-controlled safety hook of claim 22, wherein the gear assembly contains a safety lock mounted therewith and a disk-like element, said disk-like element being mounted for rotation in response to the drive means, and being provided on one side thereof with means for disengaging the safety lock for releasing the safety hook for counterclockwise movement.

28. The remote-controlled safety hook of claim 27, wherein the safety switch is attached to the safety lock for engagement with said lug means.

29. The remote-controlled safety hook of claim 27, wherein the disk-like element is provided with a pin means on the other side thereof and the hook-shaped member is provided with a connecting arm which is adapted to engage and disengage with said pin means in response to the rotation of said disk-like element, said hook-shaped member moving from a closed to an open position during said movement.

30. The remote-controlled safety hook of claim 27, wherein an additional switch means is operatively associated with the gear assembly and is mounted for providing continual rotation of the disk-like element, thereby releasing the safety lock to a position for locking the hook-shaped member when said member is manually closed.

31. The remote-controlled safety hook of claim 22, wherein spring means are operatively associated with the hook-shaped member for holding the hook-shaped member in either an open or closed position.

* * * * *